US005967847A

United States Patent [19]

Newman

[11] Patent Number: 5,967,847

[45] Date of Patent: Oct. 19, 1999

[54] LAMPSOCKET WITH MEANS TO REJECT INCORRECTLY DIMENSIONED LAMPS

[75] Inventor: Walter Newman, Bayside, N.Y.

[73] Assignee: Leviton Manufacturing Co., Inc., Little Neck, N.Y.

[21] Appl. No.: 08/960,157

[22] Filed: Oct. 29, 1997

Related U.S. Application Data

[63] Continuation of application No. 08/639,539, Apr. 29, 1996, Pat. No. 5,683,271, which is a continuation of application No. 08/232,567, Apr. 25, 1994, abandoned.

[51] Int. Cl.[6] ..... H01R 33/22

[52] U.S. Cl. ..... 439/613; 439/340

[58] Field of Search ..... 439/613, 611, 439/614, 615, 665, 699, 588, 339, 340, 356, 360, 243

[56] References Cited

U.S. PATENT DOCUMENTS

| | | | |
|---|---|---|---|
| 625,903 | 5/1899 | Schirner | 439/699.2 |
| 2,695,393 | 11/1954 | Tiscione | 439/340 |
| 3,783,435 | 1/1974 | Fisher | 439/340 |
| 4,429,942 | 2/1984 | Johnson et al. | 439/340 |
| 4,928,032 | 5/1990 | Skoch et al. | 439/243 |
| 5,380,215 | 1/1995 | Huang | 439/340 |

*Primary Examiner*—Hien Vu
*Attorney, Agent, or Firm*—Paul J. Sutton

[57] ABSTRACT

A lampsocket is provided with a body having an extension both of which contain a continuous bore of a first predetermined diameter dimension to prevent the seating and electrical connection of an electrical lamp having a neck dimension in excess of first predetermined dimension to thereby reject inappropriate lamps and only permit the seating and electrical connection of suitable lamps.

2 Claims, 3 Drawing Sheets

LAMPSOCKET WITH MEANS TO REJECT INCORRECTLY DIMENSIONED LAMPS

This application is a continuation of application Ser. No. 08/639,539, U.S. Pat. No. 5,683,271, filed Apr. 29, 1996 which in turn is a continuation of application Ser. No. 08/232,567 filed Apr. 25, 1994 and now abandoned.

BACKGROUND OF THE INVENTION

1. Field of the Invention

The present invention pertains generally to lampholders for receiving lamps, and more particularly to a family of lampholders for use with low wattage medium base metal halide lamps which reject inappropriately dimensioned lamps.

2. Description of the Prior Art

The prior art teaches metal halide lamps which include a relatively centrally located arc tube situated within the confines of an outer glass bulb. These arc tubes are conventionally made of quartz and operate at extremely high temperatures and relatively high pressures. Under certain undesirable conditions, a system failure or internal factors will result in a safety hazard being created, whereby a violent shattering of the arc tube will send hot glass and lamp parts into contact with the bulb glass which, in turn, will break, releasing the hot glass and lamp parts into the surrounding environment. Under such conditions, there is an obvious risk of severe personal injury, fire and/or property damage.

For this reason normally such conventional metal halide lamps are supported within what are referred to as "enclosed" fixtures whose structure is designed to contain violently released hot glass and lamp parts. A cover lens is used in such fixtures. In addition, significant reductions in such potential violent failures can be achieved by relamping before the rated end of the life of the lamp. Another conventional manner in which such potential violent failures are reduced includes the user's periodically turning off the lamp to permit its cooling, so that upon relighting, a non-violent or less violent lamp failure is facilitated.

SUMMARY OF THE INVENTION

Relatively recently, there has been a development in the field of low wattage metal halide lamp technology which affects both lamps and lampholders. Manufacturers of metal halide lamps are selling lamps for use in what are referred to as "open" fixtures, in which the lamp is mounted such that it is exposed during its use. In order to reduce or eliminate the risks associated with violent lamp failures in non-enclosed environments, a newer metal halide lamp has been developed by manufacturers such as Venture Lighting in which a relatively thick shroud of quartz is situated intermediate the arc tube and the outer bulb glass such that, in the event of a violent lamp failure of the type described above, the shroud is intended to intercept and contain the hot glass and lamp parts which would otherwise impact and possibly break the bulb glass. The intended result is a less expensive and equally safe lamp and fixture combination suitable for indoor commercial lighting applications such as offices and retail spaces, as well as other environments.

A physical difference exists in the outer bulb glass configuration between what will be referred to herein as the newer "shrouded" lamp and its earlier unprotected version. More specifically, the diameter of the bulb glass proximate the area where this glass is joined to the lamp's screw shell is smaller in the case of the shrouded lamps than that of the unprotected lamps.

It is an object of the present invention to take advantage of the differences in bulb configurations in shrouded and unprotected metal halide lamps to provide a safety lampholder which will functionally accept a shrouded lamp but not an unprotected lamp.

It is another object of the present invention to provide a safety lampholder system which will not supply electrical current to an unprotected metal halide lamp improperly attempted to be inserted therein, whether deliberately or inadvertently.

It is a further object of the present invention to eliminate a potential safety hazard condition associated with attempts to install unprotected metal halide lamps in "open" or non-enclosed fixtures.

Still another object is to provide a safety lampholder system whose internal structural configuration includes interfering surfaces which prevent the electrically conductive elements of an unprotected metal halide lamp from coming into contact with the "live" or electrically conductive lampholder shell and center contact.

Other objects will become apparent to the reader from the following specification and claims, read in conjunction with the accompanying drawings.

BRIEF DESCRIPTION OF THE DRAWING

In the drawings in which similar elements are given similar reference characters.

DESCRIPTION OF THE PREFERRED EMBODIMENT

Figure 1:
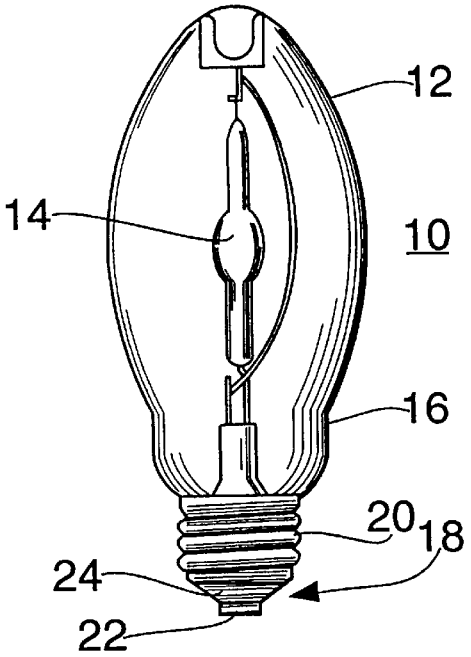
FIG. 1 is a side elevational view of a conventional low wattage metal halide lamp intended for use in an "enclosed" fixture.
Figure 3:
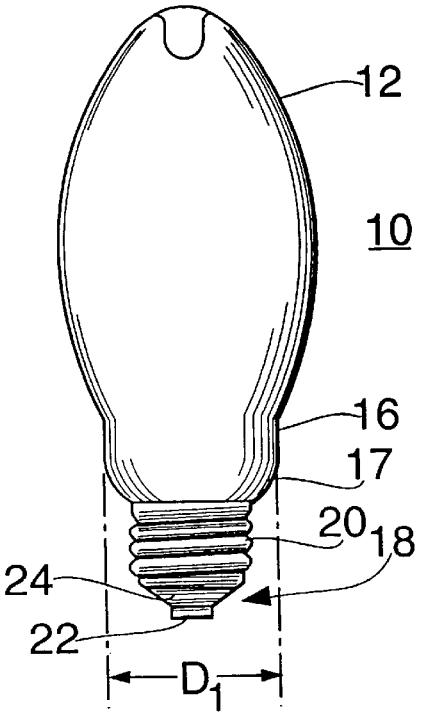
FIG. 3 is a front elevational view of a lamp of the type shown in FIG. 1.

Referring to FIGS. 1 and 3 there is shown a conventional, non-shrouded, low-wattage metal halide lamp 10 intended for use in an "enclosed" fixture (not shown). Lamp 10 has a glass outer bulb 12 in which is placed a relatively centrally located quartz arc tube 14. The neck 16 of the outer bulb 12 terminates in a screw base 18 having an outer helical rib 20 and contact button 22 supported and electrically insulated from base 18 by insulator 24. Neck 16 has a diameter $D_1$ and the transition from neck 16 to screw base creates a shoulder 17.

Figure 2:
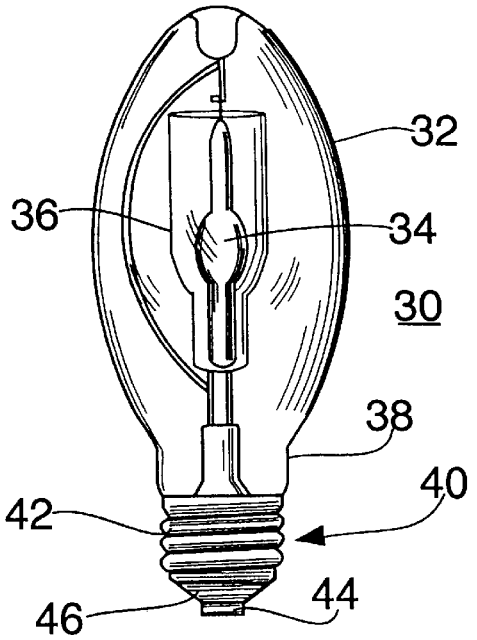
FIG. 2 is a side elevational view of the recently developed low wattage metal halide lamp intended for use in an "open" fixture.
Figure 4:
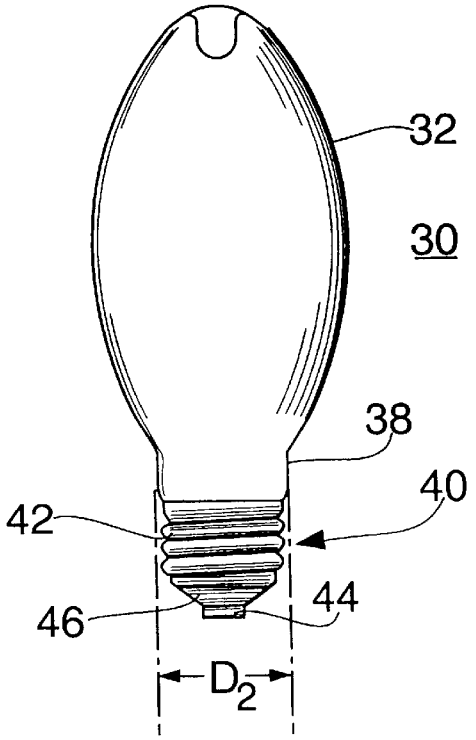
FIG. 4 is a front elevational view of a lamp of the type shown in FIG. 2 drawn to the same scale as the lamp of FIG. 3.

In FIGS. 2 and 4 there is shown a recently developed low wattage metal halide lamp 30 intended for use in an "open" fixture (not shown). Lamp 30 has a glass outer bulb 32 in which is placed a relatively centrally located quartz arc tube 34. Interposed about arc tube 34 is thick shroud 36 of quartz. The neck 38 of the outer bulb 32 terminates in a screw base 40 having an outer helical rib 42 and a contact button 44 supported and electrically insulated from base 40 by insulator 46. Neck 38 has a diameter $D_2$ which is smaller than the diameter $D_1$ , of neck 16 of bulb 10.

Figure 5:
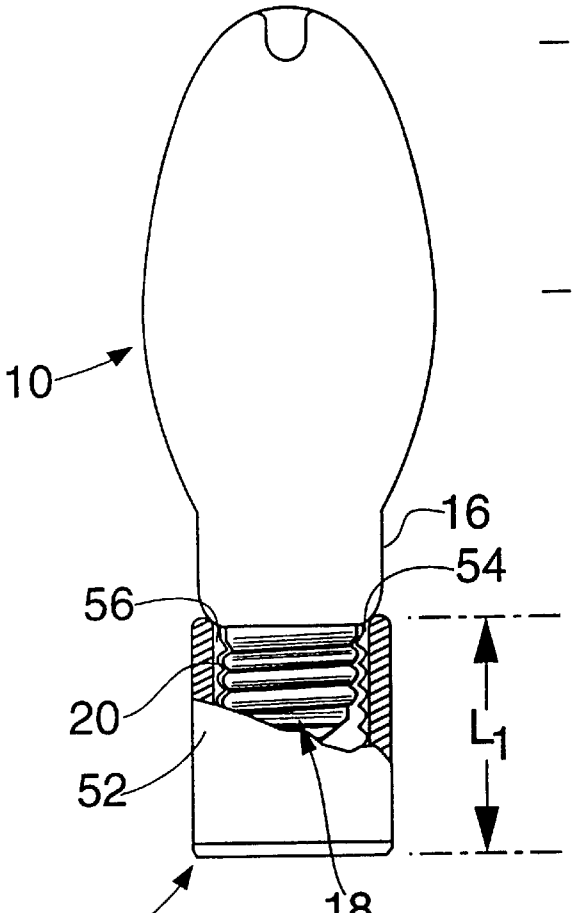
FIG. 5 is a front elevational view of the lamp of FIG. 3 installed in a conventional lampsocket, a portion of which has been removed to better appreciate the details of the lamp and lampsocket.

Turning now to FIG. 5 there is shown a bulb 10 installed in a conventional lampsocket 50. Lampsocket 50 has a lampsocket body 52 made of materials such as porcelain with a central bore 54 therein. Arranged on the walls of central bore 54 is an internal thread means 56 to cooperate with helical rib 20. The dimensions, pitch etc. employed for helical rib 20 and thread means 56 are according to American Standards for a medium base bulb. Any other suitable standard could also be adopted. The thread means 56 are conveniently connected to the negative terminal of an AC source (not shown). The button 22 (FIG. 3) is made to contact a centrally located contact means in lampsocket body 52 (not shown) which is connected to the positive terminal of the same AC source (not shown). The wiring of the thread means 56 and the contact means of lampsocket 50 are conventional. The lampsocket 50 has a length L1.

Figure 6:
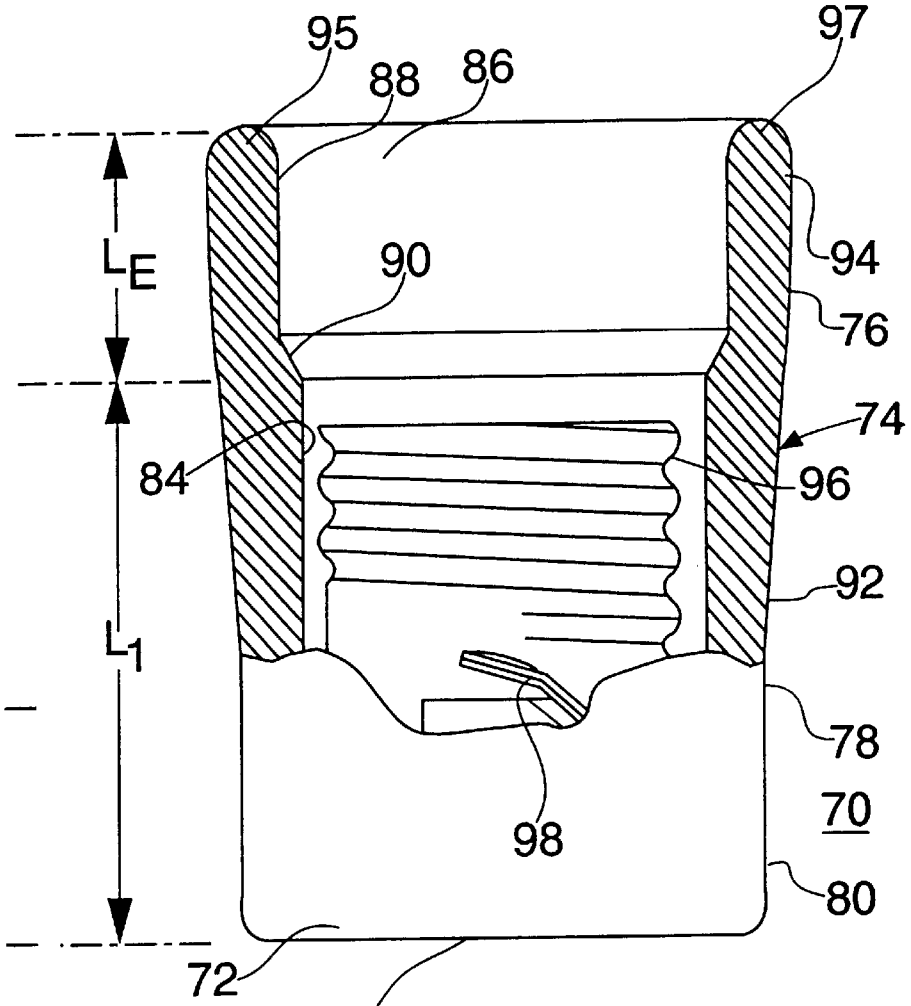
FIG. 6 is a front elevational view, partly in section, with a portion of the body removed, of a lampsocket constructed in accordance with the concepts of the invention.

FIG. 6 shows a lampsocket 70 constructed in accordance with the concepts of the invention. Lampsocket 70 has a porcelain lampsocket body 72 having an outer surface 74 which tapers as at 76 from a maximum dimension at its free end 86 to a minimum dimension as at 78 which continues along cylindrical surface 80 to end surface 82. A central cylindrical bore 84 extends from adjacent end surface 82 towards open end 86. The entry to central bore 84 is enlarged as at 88 and the transition from 88 to 84 forms an outwardly inclined surface 90. The portion of lampsocket body 72 beyond inclined surface 90 is considered an extension 94 of the lampsocket body portion 72 and represents the portion of lampsocket 70 beyond an equivalent socket for lamp 10. In other words, the lampsocket portion 92 has a length L1 which is equal to the overall length of lampsocket body 50 of FIG. 5. Lampsocket body 72 is longer than lampsocket body 50 by extension 94 which has a length LE. The free end of extension 94 is rounded as at 95 to provide a stop shoulder 97.

Figure 7:
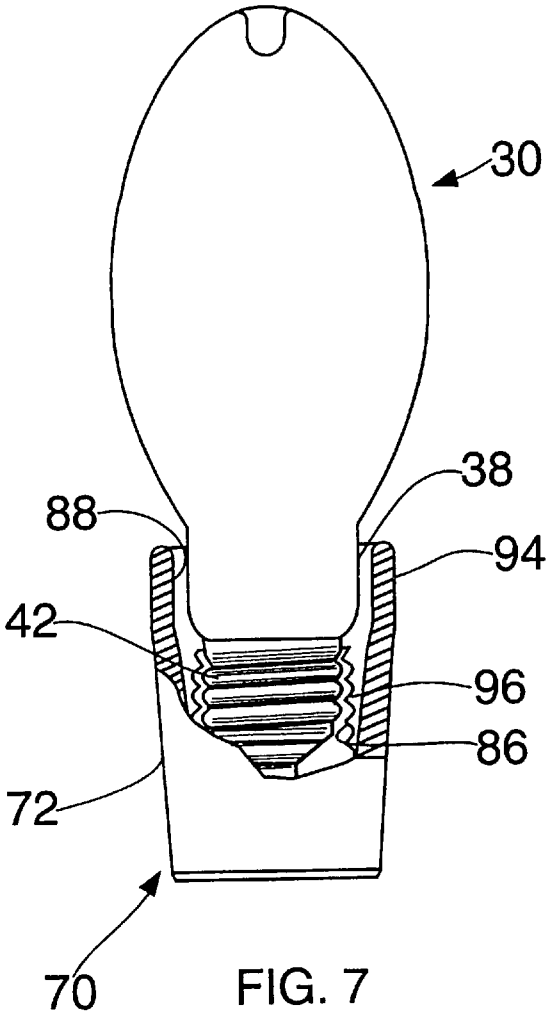
FIG. 7 is a front elevational view of the lampsocket of FIG. 6 partly in section, with a portion removed and with a lamp of the type shown in FIG. 4 installed.

Within lampsocket body 72, bore 84 is an internal thread means 96 to cooperate with the helical rib 42 (FIG. 4) of an inserted lamp 30. Centrally located contact means 98 is intended to make mechanical and electrical contact with contact button 44 of lamp 30 (FIG. 4). Internal thread means 96 and contact means 98 are connected to an AC source in a conventional manner. The diameter of bores 84 and 88 are slightly greater than diameter $D_2$ of the bulb 30 of FIG. 4 but less than the diameter $D_1$ of bulb 10 of FIG. 3. As a result bulb 30 of FIG. 4 can be placed into lampsocket 70 and its outer helical rib 42 can be made to engage internal thread means 96 and advance until button contact 44 engages contact means 98. This is shown generally in FIG. 7 wherein the neck 38 of lamp 30 is permitted to enter bores 88, 86 and have rib 42 engage thread means 96 until contact button 44 engages contact means 98 (not shown).

Figure 8:
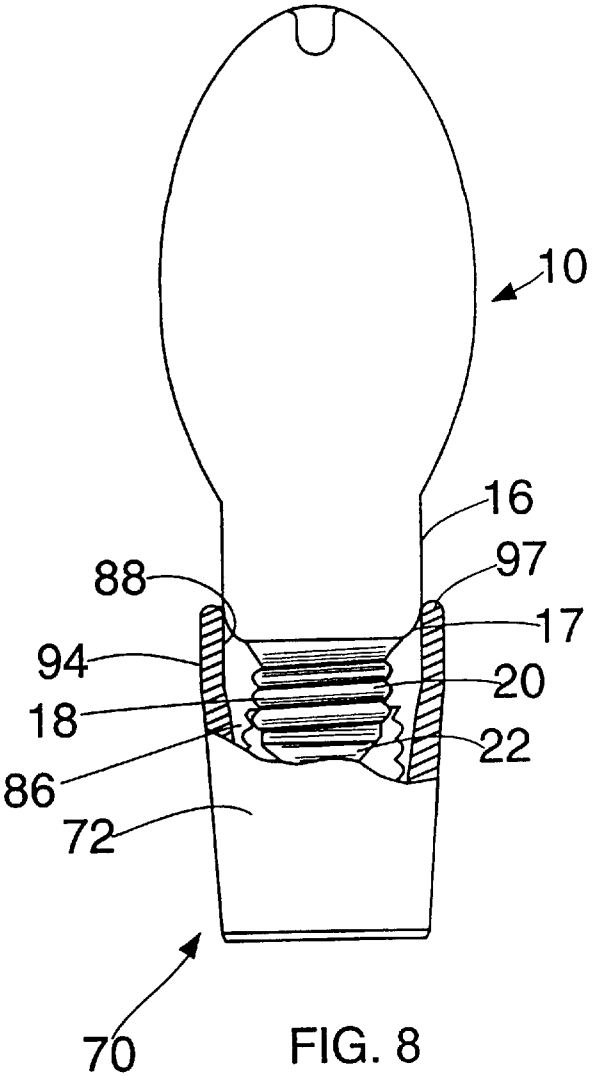
FIG. 8 is a front elevational view of the lampsocket of FIG. 6, partly in section, with a portion removed and with a lamp of the type shown in FIG. 3 shown in the lamp rejection position.

In the event that it is attempted to insert a lamp 10 into lampsocket 70 the following will occur as shown in FIG. 8. The base 18 will pass through bore 88 into bore 86 until the shoulder 17 of lamp 10 engages stop shoulder 97 of extension 94 at which point lamp 10 remains. In this position minimal contact is be made between rib 20 and internal thread means 96 and no contact is made between contact button 22 and contact means 98 and the lamp 10 can not thus be powered.

That a lamp 30 could be powered in a lampsocket 50 is of no concern since the lamp 30 is provided the internal protection of the shroud 36.

While there have been shown and described and pointed out the fundamental novel features of the invention as applied to the preferred embodiments, it will be understood that various omissions and substitutions and changes of the form and details of the device illustrated and in its operation may be made by those skilled in the art, without departing from the spirit of the invention.

The embodiments of the invention in which an exclusive property or privilege is claimed are defined as follows:

1. A lampsocket to prevent the full insertion of a lamp other than a special lamp into said lampsocket, said special lamp having a central base contact, an externally threaded metal lamp base portion of a first predetermined diameter, a lamp neck portion having a second prcdetermined diameter greater than said first predetermined diameter and less than the diameter of a lamp neck portion of a conventional lamp, said lamp socket comprising:

a) a lampsocket body fabricated from insulating materials having a generally cylindrical configuration extending from an open first end to a substantially closed second end;

b) a central bore in said lampsocket body extending from said first end to said second end, said central bore having a third predetermined diameter greater than said first predetermined diameter;

c) a generally cylindrical extension having a length being substantially as high as said lamp neck of said special lamp and having a first end and a second free open end having a rounded stop shoulder at said second free open end, said first end of said extension being integrally formed with said first end of said lampsocket;

d) a bore in said extension communicating with said central bore and having a fourth predetermined diameter less than said second predetermined diameter of said lamp neck portion of said special lamp said lamp neck portion of a conventional lamp other than a special lamp coming to rest at said rounded stop shoulder and prevented from fully entering into said lampsocket body and e) an internally threaded means having a length substantially equal to a length of said central bore and a uniform internal diameter substantially equal to said first predetermined diameter, said internally threaded means adapted to be coupled to one line of a two line source of electric current.

2. A lampholder, as define in claim 1, further comprising:

a) a base contact mounted adjacent said substantially closed second end of said lampsocket body, said base contact arranged to engage said central base contact of said special lamps, said base contact adapted to be coupled to a second line of a two line source of electric current.

* * * * *